US008005242B2

(12) United States Patent
Hsu et al.

(10) Patent No.: US 8,005,242 B2
(45) Date of Patent: Aug. 23, 2011

(54) ALTERNATIVE SENSING CIRCUIT FOR MEMS MICROPHONE AND SENSING METHOD THEREOF

(75) Inventors: Yu-Chun Hsu, Taichung County (TW); Wen-Chieh Chou, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 1159 days.

(21) Appl. No.: 11/734,793

(22) Filed: Apr. 13, 2007

(65) Prior Publication Data

US 2008/0157129 A1 Jul. 3, 2008

(30) Foreign Application Priority Data

Dec. 29, 2006 (TW) ..... 95149985 A

(51) Int. Cl.
*H04R 3/00* (2006.01)

(52) U.S. Cl. ..... 381/111; 381/113; 257/254

(58) Field of Classification Search ..... 381/113, 381/123, 150, 175, 191, 355, 111, 122, 115, 381/114, 120, 26; 257/254, 414–416
See application file for complete search history.

(56) References Cited

U.S. PATENT DOCUMENTS

| | | | | |
|---|---|---|---|---|
| 2003/0194100 | A1* | 10/2003 | Boor | 381/111 |
| 2006/0062406 | A1* | 3/2006 | Kinoshita | 381/113 |
| 2007/0160234 | A1* | 7/2007 | Deruginsky et al. | 381/113 |
| 2009/0003629 | A1* | 1/2009 | Shajaan et al. | 381/113 |

* cited by examiner

*Primary Examiner* — Xu Mei
*Assistant Examiner* — Lun-See Lao
(74) *Attorney, Agent, or Firm* — Jianq Chyun IP Office

(57) ABSTRACT

An alternative sensing circuit for a micro-electro-mechanical system (MEMS) microphone and a sensing method thereof are provided. The sensing circuit reads out output signals of an MEMS electret microphone or an MEMS condenser microphone. In considering different operating requirements of the different MEMS microphones, for example, low power consumption for the MEMS electret condenser microphone or high sensitivity for the MEMS condenser microphone, the manner of using two kinds of MEMS microphone sensing components in one circuit can significantly increase the flexibility of using the MEMS microphone and can be applied to the application or design of a condenser sensing component.

12 Claims, 3 Drawing Sheets

ALTERNATIVE SENSING CIRCUIT FOR MEMS MICROPHONE AND SENSING METHOD THEREOF

CROSS-REFERENCE TO RELATED APPLICATION

This application claims the priority benefit of Taiwan application serial no. 95149985, filed Dec. 29, 2006. All disclosure of the Taiwan application is incorporated herein by reference.

BACKGROUND OF THE INVENTION

1. Field of the Invention

The present invention relates to a sensing circuit for a micro-electro-mechanical system (MEMS) microphone. More particularly, the present invention relates to an integrated alternative sensing circuit for an MEMS microphone and a sensing method thereof.

2. Description of Related Art

Micro-Electro-Mechanical System (MEMS) technique is a design based on microminiaturized mechanical structures, which among others, is mainly used in three fields including micro sensor, micro actuator, and micro structure components. The micro sensor can employ relative semiconductor process techniques, and thus can be integrated with integrated circuits (ICs). Therefore, the competitiveness of this technique is improved, and this technique is also highly regarded. Micro sensor is a micro component having characteristics of a sensor, and can converts external physical or chemical status (e.g. light, heat, magnetism, sound, pressure, position etc.) into the electrical signal for the process of any signal which usually is the signal that can be easily controlled and processed, such as voltage or current. The micro sensor using the MEMS process can have the function of conventional sensing components, and even can have the sensing function that cannot be achieved by the conventional sensing components by the use of microminiaturized micro sensing components.

Currently, many micro sensors are fabricated by the MEMS process, and for example, pressure sensors, accelerometers, IR sensors, temperature sensors, chemical sensors, flow sensors, and acoustic sensors are embodied one after another.

The emergence of MEMS microphone components impels the development of many new forms of applications. Due to the characteristics of being microminiaturized and easily integrated with IC chip for the process of signal, this MEMS microphone enables people to sense various sounds. For example, the microphones in array can determine the direction of a sound source. For example, the multi-sensor can enhance the use function of the sensing mechanism.

The MEMS microphones currently in use can be divided into two kinds, namely MEMS electret condenser microphone (ECM) and MEMS condenser microphone. The architecture of the MEMS electret condenser microphone includes a material layer, e.g., Teflon implanted into the ECM, and as the layer material has the function of accumulating charges, this kind of microphone can directly sense the change of the acoustic pressure in the absence of an applied bias, and further convert it into electrical signals for the subsequent signal processing.

The MEMS condenser microphone is a kind of microphone that does not have an electret material. In other words, when this kind of microphone is used, an applied bias, usually a voltage above 12 V, is required. Therefore, this kind of microphone when used in a subsequent circuit will lead to the increase of the overall power consumption of the chip. However, as this kind of the architecture has preferred sensing sensitivity and low sensitivity to temperature, it becomes a main objective of research.

In FIG. 1, a sensing circuit 100 of an MEMS condenser microphone according to the conventional art is shown. When the circuit is in an initial state, the MEMS condenser microphone component 110 provides a required bias at an end point N1 by the use of a bias resistor 120 through the power supply VDD, and another end of the MEMS condenser microphone component 110 is connected to a ground end GND. The bias resistor 120 and the MEMS condenser microphone component 110 form a filer for blocking unnecessary noise signals and providing signals of the frequency band for an audio. When an acoustic pressure is transmitted to the MEMS condenser microphone component 110, the displacement of the condenser changes, so the charge accumulated on the condenser changes, and further the signal changes. The signal is input to the input end of the front-end buffer amplifier 140 through the DC blocking condenser 130, such that the signal is amplified and then transmitted to the output end Vout, thus finishing the capture of signal.

In FIG. 2, a sensing circuit 200 for an MEMS electret condenser microphone according to the conventional art is shown. In the sensing circuit 200, an MEMS electret condenser microphone component 210 is an component with a built-in charge-accumulating layer, which can have the function of accumulating charges in the absence of the applied bias. The MEMS electret condenser microphone component 210 is directly connected to an end of the DC blocking condenser 230 via an end point N2, and another end is connected to the ground end GND via the end point N2. By adding a resistor 220 between the end points N1 and N2, a filter can be formed for blocking unnecessary noise signals and providing signals of the frequency band for an audio. The material of the charge-accumulating layer in the MEMS electret condenser microphone component 210 is mostly Teflon. When the acoustic pressure is transmitted to the MEMS electret condenser microphone component 210, the accumulated charge amount changes, thus changing the magnitude of the signal. The signal is transmitted to the input end of the front-end buffer amplifier 240 through the DC blocking condenser 230, and then the signal is transmitted to the output end Vout.

However, in the current application of MEMS microphones, microphones with different specifications must be selected according to different application environment. For example, in a lower power environment, the MEMS electret condenser microphones are mostly used, and in a high sensitivity environment, the MEMS condenser microphones are mostly used. The operating methods of the two kinds of microphones are not exactly the same, so a signal sensing circuit that can simultaneously process signals of the two kinds of microphones is desired, which can increase the flexibility of using the MEMS microphone and improve the service efficiency of the microphone.

SUMMARY OF THE INVENTION

Accordingly, the present invention is directed to an integrated circuit integrating a sensing circuit for an MEMS microphone and a sensing method thereof. The integrated circuit is switched to read an output signal of an MEMS electret condenser microphone or an MEMS condenser microphone according to the applying environment.

The present invention provides an integrated circuit integrating a sensing circuit for an MEMS microphone and a sensing method thereof. The integrated circuit is switched to read the output signal of the MEMS electret condenser microphone or the MEMS condenser microphone according to the requirements including the operating power and sensitivity.

The sensing circuit for the MEMS microphone of the present invention includes an MEMS condenser microphone component, an MEMS electret condenser microphone component, first, second, third and fourth switches, and a bias resistor. The sensing circuit for the MEMS microphone of the present invention selectively forms a first current path or a second current path. When the first switch and the third switch are turned on, the first current path is formed, and the second switch and the fourth switch are turned off. The first current path allows the MEMS condenser microphone component to obtain a bias from the voltage source through the bias component, such that the MEMS condenser microphone component senses an acoustic wave signal as the output of the sensing circuit for the MEMS microphone. When the second switch and the fourth switch are turned on, the second current path is formed, and the first switch and the third switch are turned off. The second current path allows outputting the sensing result of the acoustic wave sensed by the MEMS electret condenser microphone component as the output of the sensing circuit for the MEMS microphone.

In the sensing circuit for the MEMS microphone, the first switch, the second switch, the third switch, and the fourth switch are composed of a plurality of metal-oxide-semiconductor (MOS) transistors or bipolar-junction-effect transistors (BJTs), and are fabricated by a complementary metal-oxide semiconductor (CMOS) process, and all the circuits are integrated on a single chip.

The sensing circuit for the MEMS microphone is composed of an MEMS condenser microphone discrete component, an MEMS electret condenser microphone discrete component, and a switch discrete component.

In the sensing method for the MEMS microphone of the present invention, the MEMS microphone includes an MEMS condenser microphone component, an MEMS electret condenser microphone component, a bias resistor, and a plurality of switches. The method includes the following steps. A control signal is input. When the control signal is in logic 1, a first current path is formed, and when the control signal is in logic 0, a second current path is formed. When the first current path is formed, the MEMS condenser microphone component is allowed to obtain a bias from a voltage source through the bias component, such that the MEMS condenser microphone component senses an acoustic wave signal, and output it as a sensing signal. When the second current path is formed, the sensing result of the acoustic wave signal sensed by the MEMS electret condenser microphone component is allowed to be output as the sensing signal. The sensing signal is output as the sensing result of the sensing circuit for the MEMS microphone.

In order to the make aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In many application environments, the requirement for specifications is usually decided according to the objectives and appeals. For example, the microphones used in mobile apparatuses such as mobile phones are mainly required to have low power consumption. Whereas, in the field of precise signal sensing such as the hearing aids, the components with high sensitivity are usually required.

The two kinds of MEMS microphones commonly used have their own advantages and disadvantages. For example, the MEMS electret condenser microphone has the advantages of low power consumption. The MEMS condenser microphone has the advantages of high sensitivity. Due to different architectures, the circuit architectures are different. Therefore, a circuit architecture that can read both the signal of the MEMS electret condenser microphone component and the signal of the MEMS condenser microphone component is desired, so that the single component can be widely applied, and the applicability of the component is enhanced.

The present invention provides an integrated circuit integrating the sensing circuit for the MEMS microphone. The integrated circuit can be switched to read the output signal of the MEMS electret condenser microphone or the MEMS condenser microphone according to the applying environment. For example, according to the requirements of the operating power and sensitivity etc., the integrated circuit is switched to read the output signal of the MEMS electret condenser microphone or the MEMS condenser microphone. The integrated circuit integrating the sensing circuit for the MEMS microphone can be switched to use the microphone output having different characteristics required, under the low power consumption environment or the high sensitivity requirement environment, such that the MEMS microphone has a wider application.

Figure 1:
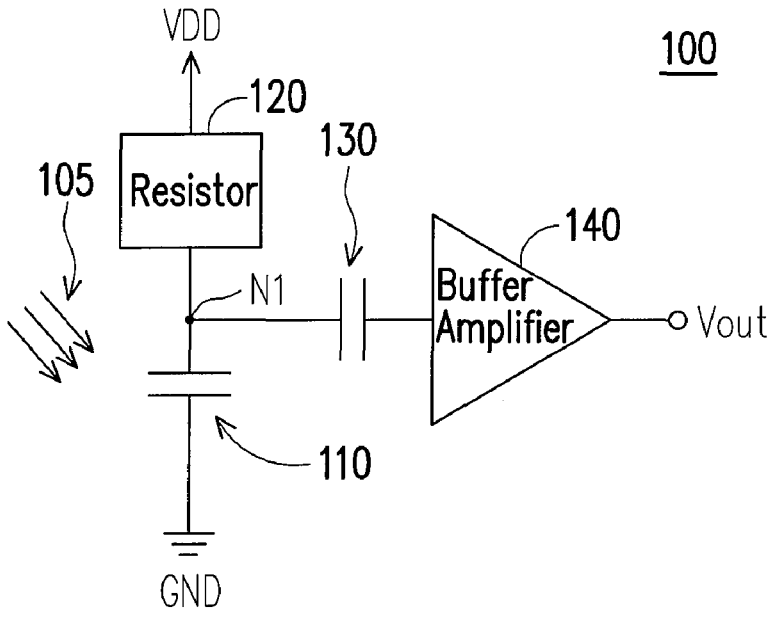
FIG. 1 (PRIOR ART)
FIG. 1 shows a sensing circuit for an MEMS condenser microphone according to the conventional art.
Figure 2:
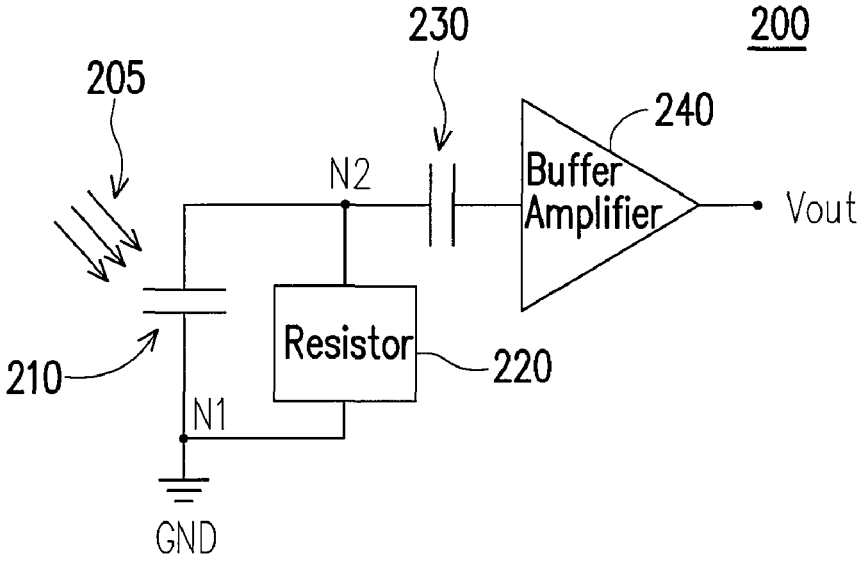
FIG. 2 (PRIOR ART)
FIG. 2 shows a sensing circuit for an MEMS electret condenser microphone according to the conventional art.
Figure 3:
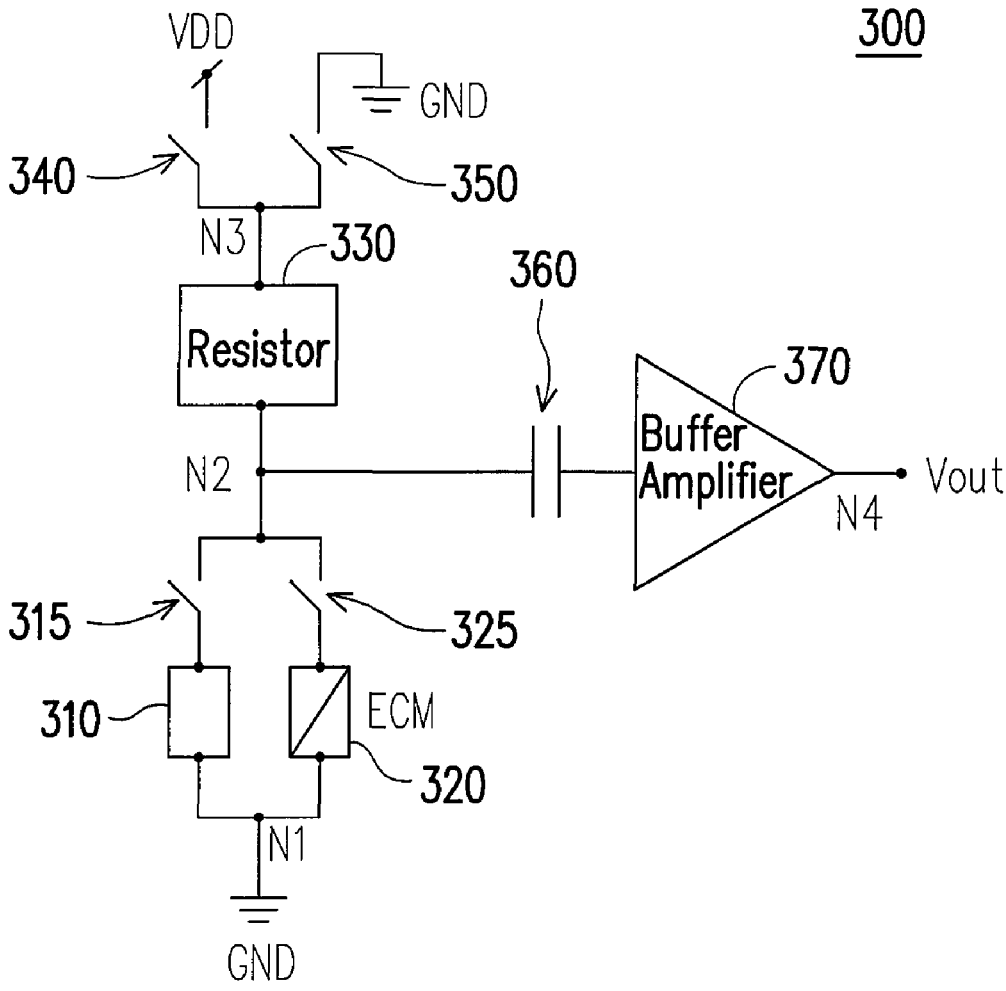
FIG. 3 is a schematic view of an alternative sensing circuit for the MEMS microphone of the integrated sensing circuit for the MEMS microphone according to an embodiment of the present invention.

In a specific embodiment of the integrated circuit integrating the sensing circuit for the MEMS microphone of the present invention, referring to FIG. 3, a schematic view of the alternative sensing circuit for the MEMS microphone is shown. The architecture of the sensing circuit 300 for the MEMS microphone includes an MEMS condenser microphone component 310, an MEMS electret condenser microphone component 320, four switches 315, 325, 330, and 340 capable of selecting the microphone component, and a bias resistor 330. The bias resistor 330 and the MEMS condenser microphone component 310 or the MEMS electret condenser microphone component 320 can form a filer for blocking unnecessary noise signals and providing signals of the frequency band for the audio. In addition, the output portion of the sensing circuit 300 for the MEMS microphone further includes a direct current (DC) blocking condenser 360 and a front-end buffer amplifier 370.

In the sensing circuit 300 for the MEMS microphone of this embodiment, when the acoustic pressure signal is transmitted to the MEMS microphone component, the sensing circuit 300 architecture can select the required MEMS microphone component to lead the sensed signal. In this embodiment, control switches 315, 325, 340, and 350 are used to select the microphone component of the required forms. When the switch 315 and the switch 340 are turned on, the MEMS condenser microphone component 310 obtains the required bias from the voltage source VDD through the bias resistor 330 via the end points N2 to N3, and another end of the MEMS condenser microphone component 310 is connected to the ground end GND via the end point N1.

When the acoustic wave signal is sensed, the acoustic wave signal is converted into an electrical signal through the MEMS condenser microphone component 310, and is transmitted to the front-end buffer amplifier circuit 370 through the DC blocking condenser 360, and then transmitted to the output end Vout. Similarly, when the required component is the MEMS electret condenser microphone component 320, the switch 325 and the switch 350 are turned on, and the subsequent operations are substantially the same as those described above, except that the voltage source is not required, thus being connected to the ground end GND through the end point N3.

In the above embodiment, the switches 315 and 325, or the switches 340 and 350 are complementary switches optimally. When the switch 315 is turned on, the switch 325 is turned off, and when the switch 325 is turned on, the switch 315 is turned off. The complementary switches can select the MEMS condenser microphone component 310 or the MEMS electret condenser microphone component 320 as the MEMS microphone component. In addition, when the switch 340 is turned on, the switch 350 is turned off, and when the switch 350 is turned on, the switch 340 is turned off, such that the selection can be switched according to whether the voltage source is required.

Figure 4:
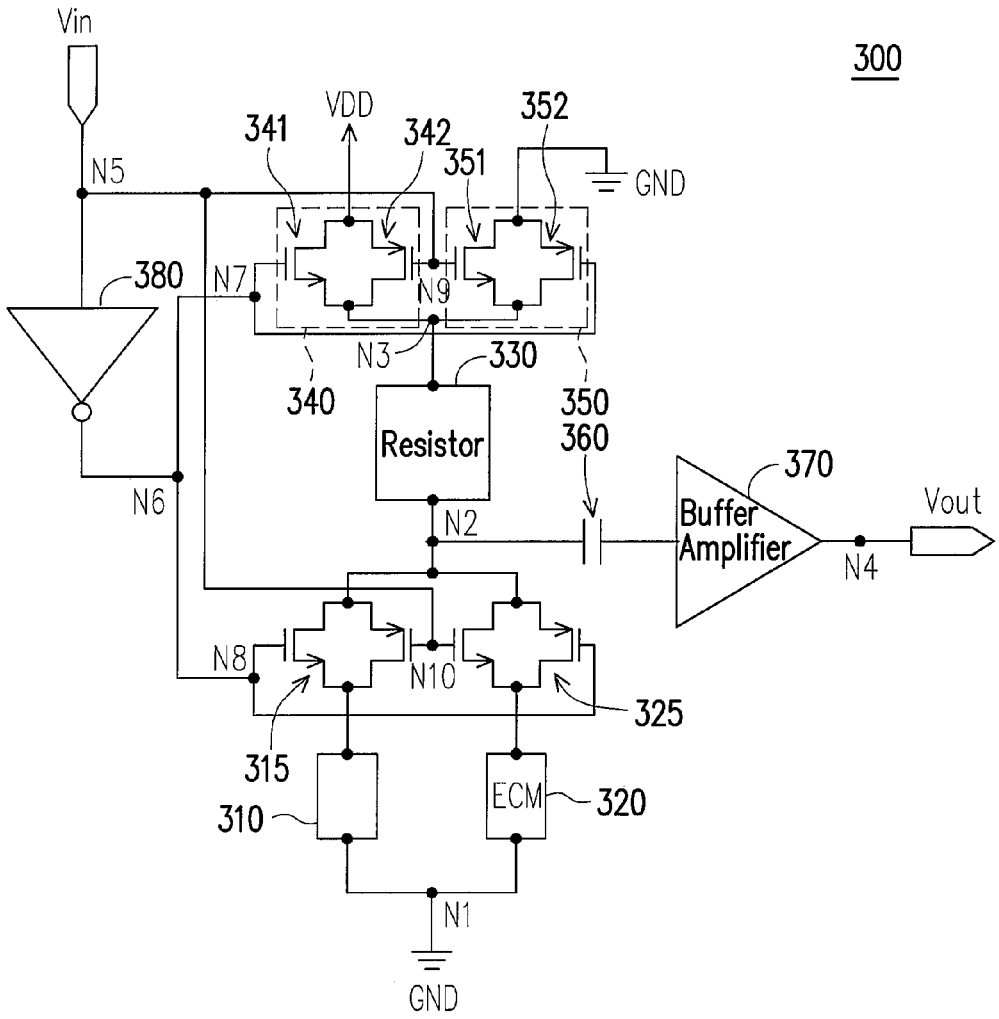
FIG. 4 is a detailed schematic circuit diagram of the integrated sensing circuit for the MEMS microphone of FIG. 3.

In the specific embodiment of the integrated circuit integrating the sensing circuit for the MEMS microphone of the present invention, referring to FIG. 4, a detailed schematic circuit diagram of the integrated sensing circuit 300 for the MEMS microphone of FIG. 3 is shown. Like component numerals are used to indicate like components, and the details will not be described herein again. In this embodiment, the switches 315, 325, 340, and 350 use logic gates as the control switches which are used to select the required microphone structure form. The logic gate is composed of a PMOS transistor and an NMOS transistor. Moreover, in this circuit architecture, an inverter 380 is added subsequent to the input signal end Vin, and the output thereof is connected to the logic gates of the switches 315, 325, 340, and 350 respectively.

In another optional embodiment, the sensing circuit 300 system for the MEMS microphone may be fabricated by the BJT technique, and is not limited to be composed of the MOS transistors.

In this embodiment, the input signal end Vin is connected to the input end of the inverter 380, and the end points N9 and N10 through the end point N5. The end point N9 is connected to the gate of the PMOS transistor 342 of the switch 340 and the gate of the NMOS transistor 351 of the switch 350, so as to control the turn on/off. The end point N10 is connected to the gate of the PMOS transistor of the switch 315 and the gate of the NMOS transistor of switch 325, so as to control the turn on/off. Similarly, the output of the inverter 380 is connected to the end points N7 and N8 through the end point N6. The end point N7 is connected to the gate of the NMOS transistor 341 of the switch 340 and the gate of the PMOS transistor 352 of the switch 350, so as to control the turn on/off. The end point N8 is connected to the gate of the NMOS transistor of the switch 315 and the gate of the PMOS transistor of the switch 325, so as to control the turn on/off. In this embodiment, the switches 315 and 325, or the switches 340 and 350 are complementary switches. When the switch 315 is turned on, the switch 325 is turned off, and when the switch 325 is turned on, the switch 315 is turned off. When the switch 340 is turned on, the switch 350 is turned off, and when the switch 350 is turned on, the switch 340 is turned off, such that the selection can be switched according to whether the voltage source is required.

In an embodiment, when the input signal of the input signal end Vin is in logic 1, the MEMS electret condenser microphone component 320 is selected, the switch 325 and the switch 350 are turned on simultaneously, the bias circuit with the MEMS electret condenser microphone component 320 as the main body is used, so as to sense the required sound signal. Similarly, when the input signal of the input signal end Vin is in logic 0, the MEMS condenser microphone component 310 is selected, the switch 315 and the switch 340 are turned on simultaneously, the bias circuit with the MEMS condenser microphone 310 as the main body is used, so as to sense the required sound signal.

To sum up, the MEMS microphone alternative sensing circuit design of the present invention can achieve that two kinds of microphone components are integrated on the same sensing circuit. For example, the circuits can be integrated through the CMOS process, and the MEMS electret condenser microphone can also be integrated therein. The CMOS process is an IC process capable of integrating all the circuits, i.e., fabricating the PMOS and the NMOS components on a silicon wafer. As the PMOS and the NMOS are complementary in feature, so is they are called CMOS. The CMOS process has the advantage that the power is consumed only when the transistor is switched to be turn on/off, so it is power saving and generates small amount of heat.

In addition, the alternative sensing circuit design for the MEMS microphone of the present invention uses a single chip and simultaneously has the disadvantages of two kinds of microphones, such as the low power consumption of the MEMS electret condenser microphone and the high sensitivity of the MEMS condenser microphone.

In addition, the alternative sensing circuit design for the MEMS microphone of the present invention can adopt a discrete circuit component design, and the alternative sensing circuit of the present invention can be achieved by the combination of the components provided by the electronic circuit IP design companies. The discrete circuit components can be applied to different products through the wire-bonding of a printed circuit. For example, the alternative sensing circuit design for the MEMS microphone of the present invention can be selectively composed of the MEMS condenser microphone discrete component, the MEMS electret condenser microphone discrete component, and a plurality of switch discrete components provided by the electronic circuit IP design companies, thus further saving the cost of the design and development.

The alternative sensing circuit design for the MEMS microphone of the present invention can increase the applying scope and the field of the products, such as the mobile apparatuses or the hearing aids, thus improving the competitiveness of the product.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An alternative sensing circuit for a micro-electro-mechanical system (MEMS) microphone, comprising:

an MEMS condenser microphone component;

an MEMS electret condenser microphone component;

a first switch and a second switch, respectively connected to the MEMS condenser microphone component and the MEMS electret condenser microphone component;

a bias component, having a first end connected to the first switch and the second switch; and a third switch and a fourth switch, respectively connected to a second end of the bias component, respectively connected to a voltage source and a ground potential, and selectively forming a first current path or a second current path, wherein when the first switch and the third switch are turned on, the first current path is formed, and the second switch and the fourth switch are turned off, and the first current path allows the MEMS condenser microphone component to obtain a bias from the voltage source through the bias component, such that the MEMS condenser microphone component senses an acoustic wave signal as the output of the sensing circuit for the MEMS microphone, when the second switch and the fourth switch are turned on, the second current path is formed, and the first switch and the third switch are turned off, and the second current path allows outputting the sensing result of the acoustic wave sensed by the MEMS electret condenser microphone component as the output of the sensing circuit for the MEMS microphone.

2. The alternative sensing circuit for the MEMS microphone as claimed in claim 1, further comprising:

a direct current (DC) blocking condenser, having a first end connected to the first end of the bias component; and a buffer amplifier, connected to a second end of the DC blocking condenser, wherein the DC blocking condenser removes the DC part from the sensing result of the acoustic wave signal sensed by the MEMS condenser microphone component or the MEMS electret condenser microphone component, and the sensing result with the DC part removed is output after being amplified by the buffer amplifier.

3. The alternative sensing circuit for the MEMS microphone as claimed in claim 1, wherein the bias component is composed of a resistor, a transistor, or a component that applies voltage bias.

4. The alternative sensing circuit for the MEMS microphone as claimed in claim 1, wherein the first switch, the second switch, the third switch, and the fourth switch are composed of a plurality of metal-oxide-semiconductor (MOS) transistors, and the MEMS condenser microphone component, the MEMS electret condenser microphone component, the first switch, the second switch, the third switch, the fourth switch, and the bias component are integrated on a single chip, and are fabricated by a complementary metal-oxide semiconductor (CMOS) process.

5. The alternative sensing circuit for the MEMS microphone as claimed in claim 1, wherein the first switch, the second switch, the third switch, and the fourth switch are composed of a plurality of bipolar-junction-effect transistors (BJTs), and the MEMS condenser microphone component, the MEMS electret condenser microphone component, the first switch, the second switch, the third switch, the fourth switch, and the bias component are integrated on a single chip, and are fabricated by a BJT process.

6. The alternative sensing circuit for the MEMS microphone as claimed in claim 1, wherein the first switch, the second switch, the third switch, and the fourth switch are composed of logic gates, respectively.

7. The alternative sensing circuit for the MEMS microphone as claimed in claim 6, wherein the first switch and the second switch, and the third switch and the fourth switch are complementary switches respectively, and are controlled to be turned on or off by an input signal.

8. The alternative sensing circuit for the MEMS microphone as claimed in claim 6, wherein the first switch, the second switch, the third switch, and the fourth switch are composed of a PMOS transistor and an NMOS transistor.

9. The alternative sensing circuit for the MEMS microphone as claimed in claim 6, wherein the first switch, the second switch, the third switch, and the fourth switch are composed of two BJTs.

10. An alternative sensing circuit for the MEMS microphone, comprising:

an MEMS condenser microphone discrete component;

an MEMS electret condenser microphone discrete component;

a first switch discrete component and a second switch discrete component, respectively connected to the MEMS condenser microphone discrete component and the MEMS electret condenser microphone discrete component;

a bias component, having a first end connected to the first switch and the second switch; and a third switch discrete component and a fourth switch discrete component, respectively connected to a second end of the bias component, and respectively connected to a voltage source and a ground potential, wherein when the first switch discrete component and the third switch discrete component are turned on, a first current path is formed, and the second switch discrete component and the fourth switch discrete component are turned off, and the first current path allows the MEMS condenser microphone discrete component to obtain a bias from the voltage source through the bias component, such that the MEMS condenser microphone discrete component senses an acoustic wave signal as the output of the sensing circuit for the MEMS microphone, when the second switch discrete component and the fourth switch discrete component are turned on, a second current path is formed, and the first switch discrete component and the third switch discrete component are turned off, and the second current path allows outputting the sensing result of the acoustic wave sensed by the MEMS electret condenser microphone discrete component as the output of the sensing circuit for the MEMS microphone.

11. The alternative sensing circuit for the MEMS microphone as claimed in claim 10, further comprising:

a DC blocking condenser, having a first end connected to the first end of the bias component; and a buffer amplifier discrete component, connected to a second end of the DC blocking condenser, wherein the DC blocking condenser removes the DC part from the sensing result of the acoustic wave signal sensed by the MEMS condenser microphone component or the MEMS electret condenser microphone component, and the sensing result with the DC part removed is output after being amplified by the buffer amplifier discrete component.

12. A sensing method for the alternative MEMS microphone, wherein the alternative MEMS microphone comprises an MEMS condenser microphone component, an MEMS electret condenser microphone component, a bias component, and a plurality of switches, the method comprising:

inputting a control signal, wherein when the control signal is in logic 1, a first current path is formed, and when the control signal is in logic 0, a second current path is formed, wherein when the first current path is formed, the MEMS condenser microphone component is allowed to obtain a bias from a voltage source through the bias component, such that the MEMS condenser microphone component senses an acoustic wave signal and output it as a sensing signal, when the second current path is formed, the sensing result of the acoustic wave signal sensed by the MEMS electret condenser microphone component is allowed to be output as the sensing signal; and outputting the sensing signal as the sensing result of the sensing circuit for the MEMS microphone.

* * * * *